United States Patent [19]

Hashimoto et al.

[11] 4,222,247

[45] Sep. 16, 1980

[54] NEEDLE SELECTION MECHANISM FOR AN AUTOMATIC KNITTING MACHINE

[75] Inventors: Takeji Hashimoto, Nagaokakyo; Yoshio Nagao; Yasushi Doi, both of Kyoto, all of Japan

[73] Assignee: Dainippon Screen Seizo Kabushiki Kaisha, Japan

[21] Appl. No.: 969,337

[22] Filed: Dec. 14, 1978

[30] Foreign Application Priority Data

Jan. 7, 1978 [JP] Japan ..... 53/735

[51] Int. Cl.[3] ..... D04B 7/00; D04B 15/66

[52] U.S. Cl. ..... 66/75.2; 66/218; 66/232

[58] Field of Search ..... 66/75.2, 232, 231, 215, 66/218

[56] References Cited

U.S. PATENT DOCUMENTS

| | | | |
|---|---|---|---|
| 3,717,014 | 2/1973 | Kohler | 66/75.2 |
| 3,805,558 | 4/1974 | Prohi | 66/75.2 |
| 3,818,726 | 6/1974 | Kazmeier et al. | 66/75.2 |

*Primary Examiner*—Ronald Feldbaum
*Attorney, Agent, or Firm*—Marvin H. Kleinberg

[57] ABSTRACT

A needle selection mechanism for an automatic knitting machine, comprising at least two selector levers mounted to a carriage which is adapted to move along a needle retainer in which are disposed a plurality of selectors for knitting needles, wherein each selector is individually engageable with one of the selector levers, and different selectors are engageable with different selector levers, and wherein the selector levers set the selectors to either "knit" or "welt" positions.

7 Claims, 4 Drawing Figures

NEEDLE SELECTION MECHANISM FOR AN AUTOMATIC KNITTING MACHINE

This invention relates to a needle selection mechanism for an automatic knitting machine. In particular it relates to improvements, whereby there are provided a plurality of selector levers for selecting needles.

In a conventional needle selection mechanism for an automatic knitting machine wherein the needle selection mechanism is controlled by picture signals depending upon a desired pattern, the knitting is carried out in one direction of motion of a reciprocating carriage. Further, when the machine is operated at high speed, the needle selection operation becomes unstable, and accordingly in order to prevent needle selection errors the moving speed of the carriage has to be restricted below a certain limit, which means the restriction of production efficiency.

Usually in a conventional machine a selector lever for controlling the positions of needle selection jacks is moved by an electromagnet. Maintaining reliable operation at high speed involves a complicated and expensive mechanism, and even in such a complicated mechanism the relation between the excitation force of the electromagnet and the raising time of the selector lever is delicate. Accordingly, its adjustment requires a long time and the probability of error or failure is high. Therefore the moving speed of the carriage must be restricted to be low.

It is an object of the present invention to provide a needle selection mechanism for an automatic knitting machine free from the aforementioned defects, which is reliable and operates faster than a conventional one, and in which the knitting can be carried out quickly and accurately.

According to the present invention there is provided a needle selection mechanism for an automatic knitting machine, comprising a needle retainer, a plurality of selectors for knitting needles disposed in the needle retainer, and a carriage adapted to move along the needle retainer, characterized in that at least two selector levers are mounted to the carriage in a manner to be selectively operable to set the selectors to either "knit" or "welt" positions, each selector being individually engageable with one of the selector levers, and different selectors being engageable with different selector levers.

In order that the present invention may be better understood, a preferred embodiment will now be described with reference to the accompanying drawings, which are given for the purposes of illustration only, and thus are not limitative of the present invention, and wherein.

Figure 1:
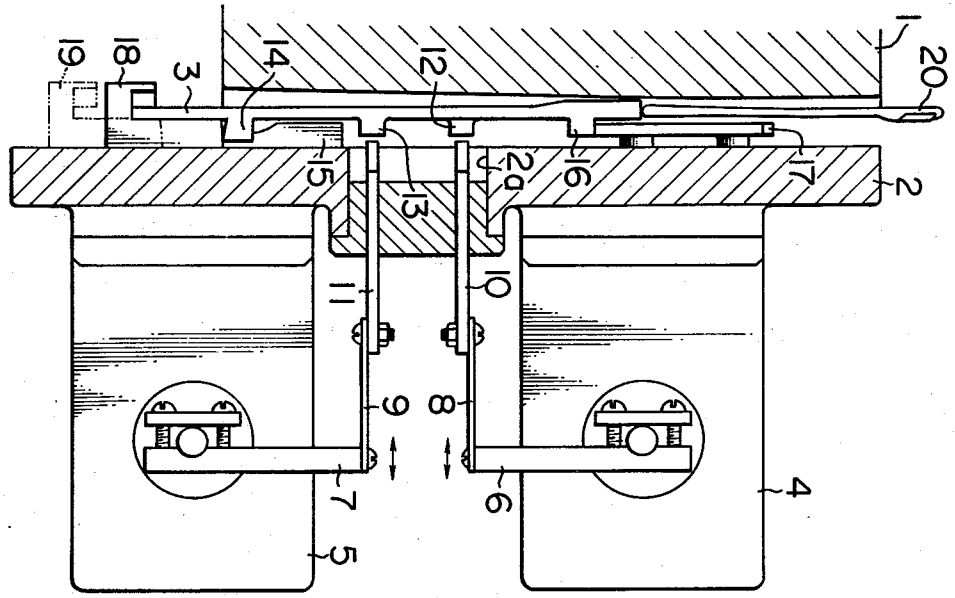
FIG. 1 is a fragmentary cross-section of a knitting machine embodying the present invention.
Figure 2:
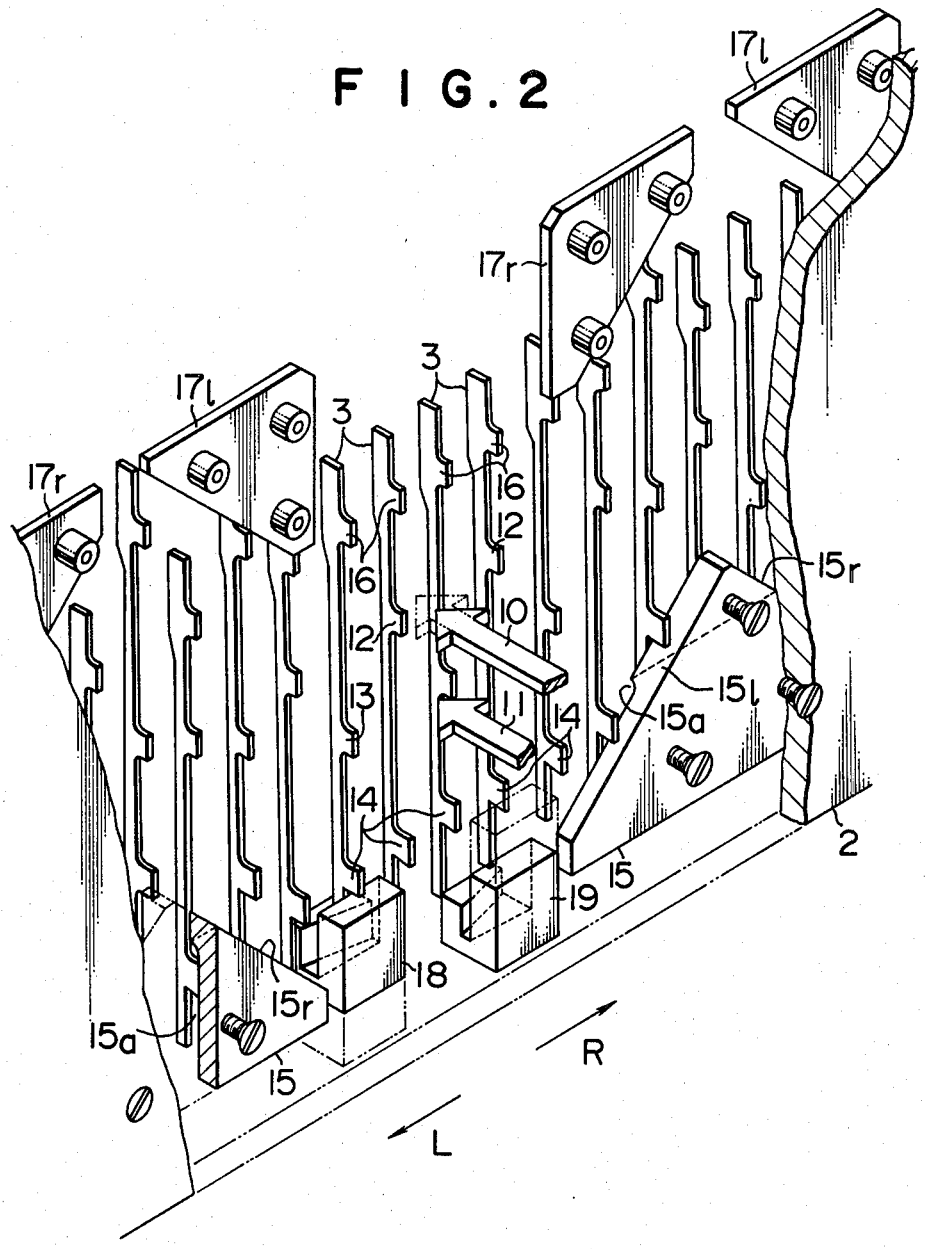
FIG. 2 is a fragmentary perspective view of the machine of FIG. 1.

Referring to FIGS. 1 and 2, there is shown the essential part of an automatic flat knitting machine. The following description is in terms of a single knit station, but it should be noted that in FIG. 2 some cams are duplicated to allow for the possibility of several knit stations. A carriage 2 is movably disposed against the front surface of a flat needle retainer 1, and is moved along the front surface thereof. A plurality of selectors 3 and knitting needles 20 placed thereon are mounted so as to be movable up and down, on the front surface of the needle retainer 1 at a certain spacing. Each selector 3 has three projections; upper 16, middle 12 or 13 and lower 14 which face the carriage 2. The upper and the lower ones are positioned at constant heights, but the middle projections are higher ones 12 and lower ones 13 alternately.

A pair of torsion solenoids 4 and 5 are mounted to the surface of the carriage 2 away from the needle retainer 1; the torsion solenoids 4 and 5 used for activating the selectors 3, as hereinafter described, may be conventional ones.

A torsion solenoid of this kind comprises a torsion shaft, and rotor cores attached thereto within a magnetic field. When the rotor cores are energized by supplying the current, a couple is exerted on the rotor cores, thereby imparting a torsion to the torsion shaft. In this case, the frequency vibration and the response speed of the torsion shaft and the rotor cores are so fast that they can, for instance, exactly respond to a input signal having a frequency as high as one kHz, and its activation and deactivation time periods are short enough to satify the requirements for the machine of the present invention.

At the free ends of the torsion shafts of the torsion solenoids 4 and 5, are fixed arms 6 and 7, whose free ends are connected to selector levers 10 and 11 via spring plates 8 and 9. The selector levers 10 and 11 are moved horizontally forwards and rearwards through a guide opening 2*a* in the carriage 2 according to the on and off actions of the torsion solenoids 4 and 5. The selector levers 10 and 11, having free ends of an arrow shape, as shown in FIG. 2, push the upper middle projections 12 and the lower middle projections 13 rearwards, i.e. to the needle retainer side.

At the side of the carriage 2 facing the needle retainer 1, raising cams 15, knitting cams 17 and reset cams 18 and 19 are mounted. The former two 15 and 17 are secured to the carriage 2, but the latter 18 and 19 are moved up and down alternately depending on the direction of movement of the carriage 2.

That is, in FIG. 2, when the carriage 2 is moved to the left, as indicated by an arrow L, the reset cam 18 is raised and the reset cam 19 is lowered, as shown by solid lines. On the other hand, if the carriage 2 is moved to the right, as indicated by an arrow R, the reset cam 18 is lowered and the reset cam 19 is raised, as shown by two-dotted lines.

Each reset cam 18 or 19 of J-shaped cross section includes a transverse groove extending along the moving direction, its outer end being widen so as to receive and align the selectors at the front position, as hereinafter described.

The operation of the machine shown in FIGS. 1 and 2 will now be described.

When the carriage 2 is moved in the leftwards direction in FIG. 2, the selectors 3 of the needle retainer 1 are aligned at the front while they pass through the groove of the reset cam 18. The selectors 3 thus aligned are set to the "knit" or "welt" (i.e. not knit) position by the selector levers 10 and 11.

That is, when the selector levers 10 and 11 are retracted, as shown in FIG. 2 by the solid lines, the middle projections 12 and 13 of the selectors 3 do not contact with the selector levers 10 and 11, and thus the selectors 3 are still positioned where they were lined up by the reset cam 18. In such positions, the lower projections 14 of the selectors 3 contact the upper slope 15*l* of the raising cam 15 which is moved together with the carriage 2. As the carriage 2 is moved, the selectors 3 and the knitting needles 20 are raised to the knit position. Then the selectors 3 together with the needles 20 are pushed down by the upper projections 16 of the selectors 3 contacting with the lower slope of the knitting cam 17*l*. At this moment, the yarn is caught by the hook ends of the needles 20, thereby carrying out the knitting.

On the other hand, when the selector levers 10 and 11 push the middle projections 12 and 13 of the selectors 3, the lower projections 14 thereof are not contacted with the raising cam 15. Hence the selectors 3 and the needles 20 are not raised by the raising cam 15, i.e. the needles 20 are held in the welt position, thereby performing no knitting.

The raising cam 15 is provided with a recess 15*a* at its lower surface facing the needle retainer 1 to allow the lower projection 14 of the selectors 3 pushed rearwards by the selector lever 10 or 11 to escape.

When the carriage 2 is moved in the rightwards direction, as shown in an arrow R in FIG. 2, the operation is conducted in the same manner as described above. In this case, the cams 17*r* and 19 and upper slopes 15*r* of the cam 15 are used.

In the embodiment of the present invention shown in FIG. 2 the tip of the selector levers 10 and 11 is formed in an arrow shape having two symmetrical oblique sides, and the three kinds of cams, the raising cams 15, the knitting cams 17, and the reset cams 18 and 19, are aligned symmetrically. Therefore, the knitting can be carried out in both directions of motion of the carriage 2.

Further, the selectors 3 having an upper or a lower middle projection 12 or 13 aligned alternately in a row, are selected alternately by using the selector levers 10 and 11 and the torsion solenoids 4 and 5. Thus, if the response speeds of the torsion solenoids 4 and 5 are the same, the carriage 2 may be moved at twice the speed of a conventional one having a single control means.

According to the present invention, since torsion solenoids having a superior response are utilized, even if the carriage 2 is moved at a speed several times faster than in a conventional machine, reliable selection of the needles can be carried out.

Furthermore, in order to perform a reliable selection of the needles, the input timing of command pulses to be supplied to the torsion solenoids, hereinafter described, may be changed according to the drive speed of the carriage 2.

Figure 3:
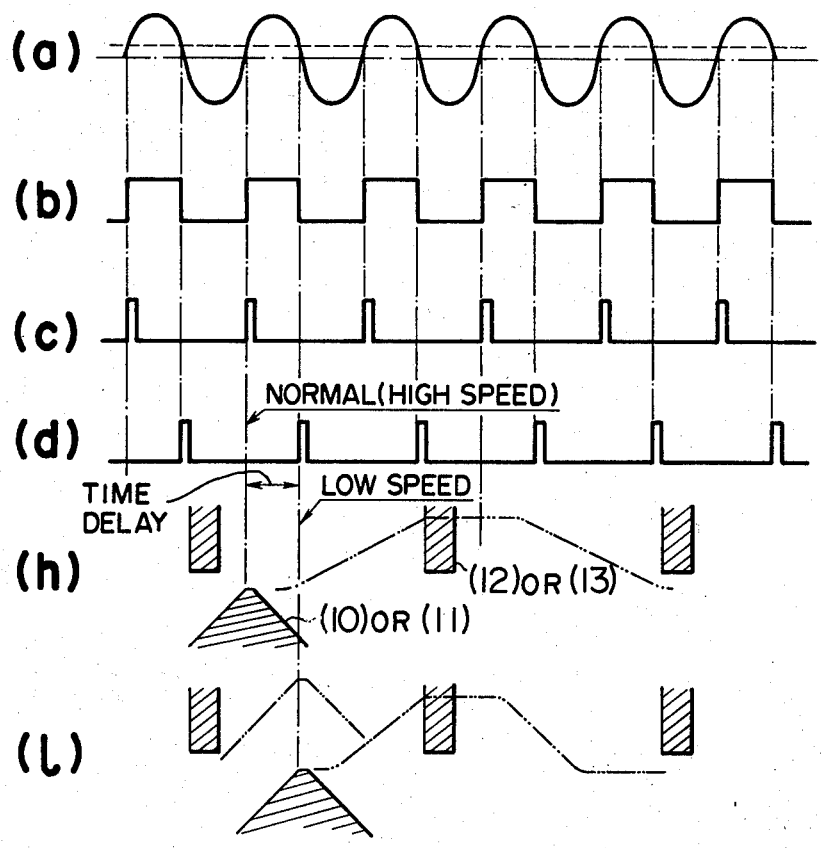
FIG. 3 is a schematic view of a timing chart for the explanation of the operation of a machine according to the present invention.

A timing chart for such an operation is shown in FIG. 3.

Clock pulses (a) for use as timing pulses are generated by a linear encoder 21 of well-known type in response to the movement of the carriage 2. That is, for example, a rack with magnets aligned with the same pitch as the knitting needles is provided on the needle retainer 1 and a magnet is attached to the carriage 2 so that the magnet of the carriage 2 is moved along the rack while the carriage is moved. The magnetic flux change caused by moving the carriage is detected by a Hall element, or the like, thereby obtaining the clock pulses (a).

The clock pulses (a) are changed to rectangular pulses (b) by slicing at a suitable level, or other methods. The leading edge portions of the rectangular pulses (b) are detected to obtain timing pulses (c), and the trailing edge portions of the rectangular pulses (b) are detected to obtain timing pulses (d).

When the carriage 2 is moved at high speed, the command pulse for advancing the selector lever 10 or 11 is input in synchronization with the timing pulse (c), thereby exactly contacting the selector lever 10 or 11 with the upper or the lower middle projection of the selector 3, as shown in FIG. 3(*h*).

When the carriage 2 is moved at low speed, the command pulse for advancing the selector lever 10 or 11 is input in synchronization with the timing pulses (d).

In a machine according to the present invention, the carriage 2 is normally driven at high speed. However, if a problem such as a break in the yarn happens, the machine is stopped and is readjusted. Then, it may be restarted at low speed.

In such low speed operation, if the command pulse for advancing the selector lever 10 or 11 is input in synchronization with the same timing pulses (c) as those for the high speed, the selector lever 10 or 11 is apt to contact the middle projection of the preceding selector 3 rather than the desired selector 3, resulting in mis-selection. In order to avoide mis-selection, the command pulse for advancing the selector lever is input in synchronization with the timing pulses (d). The command pulse for retracting the selector lever 10 or 11 is fed in synchronization with the timing pulses (c) at both high and low speeds.

Figure 4:
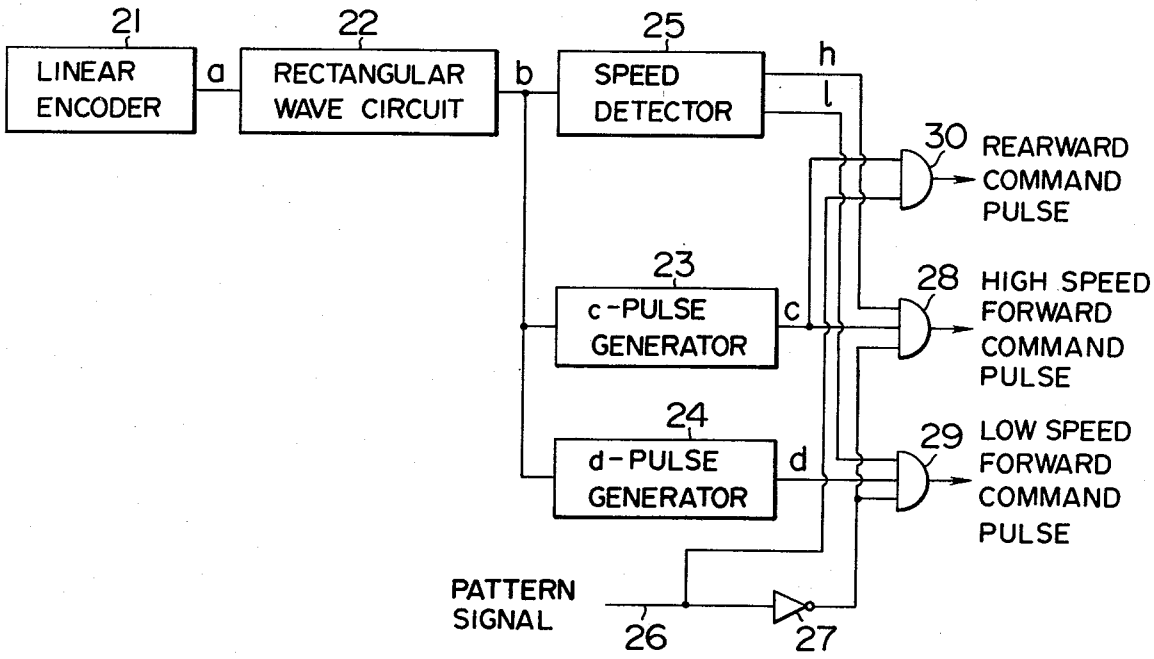
FIG. 4 is a schematic view of a circuit for automatically selecting timing pulses for high or low speed operation.

In FIG. 4 is shown a circuit for selecting the timing pulses when the carriage 2 is moved at high and low speeds.

The clock pulses (a) in FIG. 3 generated by the linear encoder 21 are converted by a rectangular wave circuit 22 to the rectangular pulses (b) in FIG. 3. The rectangular pulses (b) are input to a c-pulse generator 23 and a d-pulse generator 24, which output the timing pulses (c) and (d), respectively.

The rectangular pulses (b) are also fed to a speed detector 25 which discriminates between high and low moving speeds of the carriage 2 according to the frequency of the clock pulse (b) input using a predetermined threshold value, and outputs a high speed signal (h) when the carriage is moved at high speed, and a low speed signal (l) when the carriage is moved at low speed. Pattern signals are input on a line 26.

The high speed signal (h), the timing pulse (c), and the pattern signal through an inverter 27 (to produce the logical NOT of the pattern signal), are sent to an AND circuit 28 which outputs the high speed command pulse for advancing the selector lever 10 or 11. Therefore, when the pattern signal is not fed to the inverter 27, the selector lever 10 or 11 is moved forward and contacts the middle projection of the selector 3. Accordingly, the selector 3 is pushed to the needle retainer side, so that the selector 3 pushed does not contact with the raising cam 15, and is not raised to the knit position, but remains in the welt position.

However, when the pattern signal is input to the inverter 27, the output from the inverter 27 disappears. The AND circuit 28 does not output a command pulse, and thus the selector lever 10 or 11 is not moved forwards, and the selector 3 is raised to the knit position, thereby carrying out the knitting.

The low speed signal (l), timing pulse (d), and the output signal from the inverter 27 are fed to an AND circuit 29. When the carriage 2 is moved at low speed, the knitting is carried out depending on the pattern signals in the same manner as described above for the high speed case.

The timing pulse (c) and the pattern signal are fed to an AND circuit 30 which outputs the command pulse for retracting the selector lever 10 or 11 in synchronization with the timing pulse (c) when the pattern signal is input while the selector lever 10 or 11 is in the forward, or advanced, position.

Although the present invention has been shown and described with respect to a preferred embodiment thereof, it should be understood that various changes and modifications could be made therein by those skilled in the art, without departing from the scope of the invention.

For example, more than two torsion solenoids and selector levers may be used, the number used being determined according to the relationship between the knitting speed desired and the activation time of the selector levers.

Further, the circuit shown in FIG. 4 may be also replaced by a conventional one having the same functions, and therefore it is not intended that the present invention should be limited by the circuit in FIG. 4.

As mentioned above, it is also possible to incorporate the present invention in a knitting machine with a plurality of knitting stations arranged adjacent on the carriage. Also, while the present invention has been designed symmetrically with the use of a two directional knitting action in mind, it is not intended that this should exclude the implementation of the multi-selector lever method of the present invention to a single direction knitting machine from the scope of protection of the patent. Generally a knitting machine as described in the embodiment above will have a straight path of movement for the carriage, but this is again not a limiting feature of the present invention.

What is claimed is:

1. A needle selection mechanism for an automatic knitting machine comprising a needle retainer, a plurality of selectors for knitting needles disposed in the needle retainer, at least two selector levers for selectively setting the selectors to either "knit" or "welt" position, and a carriage adapted to move along the needle retainer, characterized in that:

the mechanism further includes a pulse generator which generates clock pulses of rectangular wave form and having a pitch synchronized with the movement of the carriage past the selectors, and a timing control circuit for controlling the timing of the moving of the selector levers by using timing pulses made from the leading edge or the trailing edge portions of the rectangular pulses for advancing the selector levers when the carriage is moved at high or low speed, respectively.

2. A mechanism according to claim 1, wherein each selector lever is individually engageable with one of the selector levers and different selectors are engageable with different selector levers.

3. A mechanism according to claim 2, wherein substantially no two adjacent selectors are engageable with the same selector lever.

4. A mechanism according to claim 3, wherein two selector levers are provided and alternate selectors engage in turn with alternate selector levers.

5. A mechanism according to either claims 1 or 4, wherein each selector lever is moved by a torsion solenoid.

6. A mechanism according to claim 5, wherein each selector lever is coupled to the torsion solenoid by a spring plate.

7. A mechanism according to claim 1, wherein the mechanism is constructed symmetrically so as to be operable with the carriage moving in either direction.

* * * * *